United States Patent [19]

Kondo et al.

[11] 3,974,805

[45] Aug. 17, 1976

[54] IGNITION SYSTEM FOR AN INTERNAL COMBUSTION ENGINE

[75] Inventors: Tetsuya Kondo, Susono; Takeshi Watanabe, Fuji, both of Japan

[73] Assignee: Kokusan Denki Co., Ltd., Numazu, Japan

[22] Filed: Oct. 9, 1974

[21] Appl. No.: 513,471

[30] Foreign Application Priority Data

Oct. 15, 1973 Japan ..... 48-114674

[52] U.S. Cl. ..... 123/118; 123/8.09

[51] Int. Cl.[2] ..... F02P 9/00; F02P 3/00

[58] Field of Search..... 123/148 E, 148 MC, 148 D, 123/118, 8.09

[56] References Cited

UNITED STATES PATENTS

| | | | |
|---|---|---|---|
| 3,589,344 | 6/1971 | Steinke | 123/8.09 |
| 3,669,086 | 6/1972 | Beuk et al. | 123/148 MC |
| 3,738,340 | 6/1973 | Olson | 123/148 E |
| 3,757,755 | 9/1973 | Carner | 123/148 E |
| 3,762,383 | 10/1973 | Richards et al. | 123/148 E |
| 3,791,356 | 2/1974 | Saita | 123/148 E |
| 3,868,928 | 3/1975 | Kishimoto | 123/8.09 |
| 3,898,963 | 8/1975 | Iwata | 123/8.09 |

*Primary Examiner*—Charles J. Myhre
*Assistant Examiner*—Ronald B. Cox
*Attorney, Agent, or Firm*—Woodling, Krost, Granger & Rust

[57] ABSTRACT

An ignition system for an internal combustion engine comprising a power supply, and an ignition circuit including an ignition coil having a primary coil portion connected to said power supply and a secondary coil portion connected to at least one ignition plug, said ignition plug disposed within an operating chamber of said engine and a contact breaker connected to said primary coil portion, said ignition system characterized by comprising means to override said ignition circuit and means to periodically effect the operation of said overriding means. Means to periodically effect the operation of said overriding means comprises a triggering signal generator to generate a triggering signal each time said contact breaker is operated, a frequency divider to divide said triggering signal from said triggering signal generator so as to produce a divided signal with the frequency of 1/n times that of said triggering signal wherein *n* is 2 or 4, with said overriding means receiving said divided signal for its operation and means to allow the operation of said overriding means only when said engine requires to periodically fail to ignite said operating chamber.

9 Claims, 3 Drawing Figures

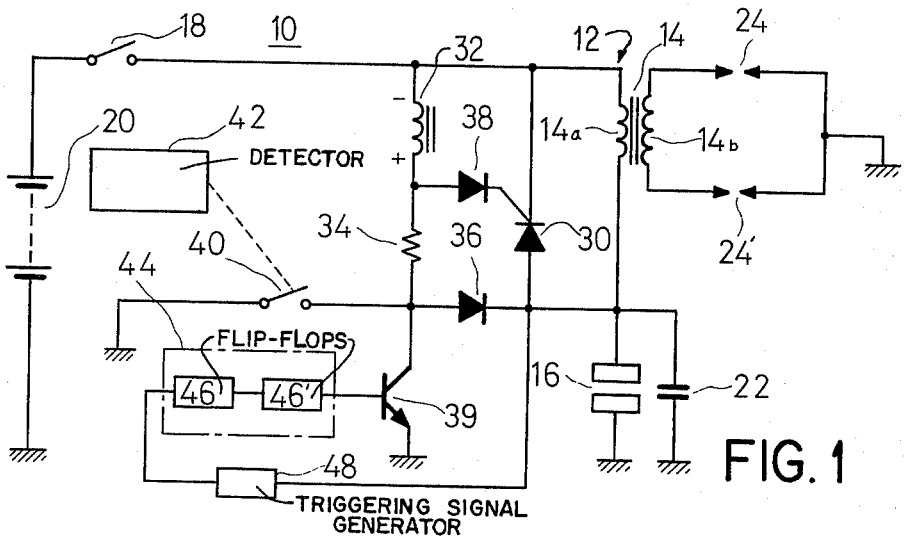
FIG. 1
FIG.2a
FIG.2b
FIG.2c
FIG.2d
FIG.2e
FIG.2f
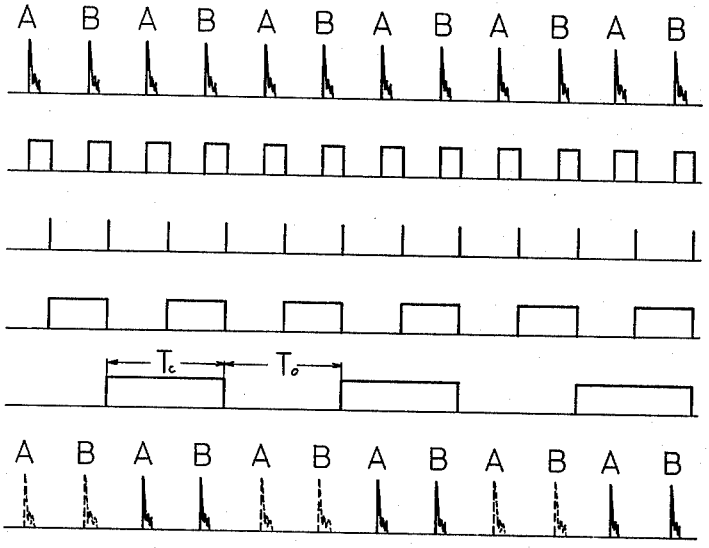
FIG.3
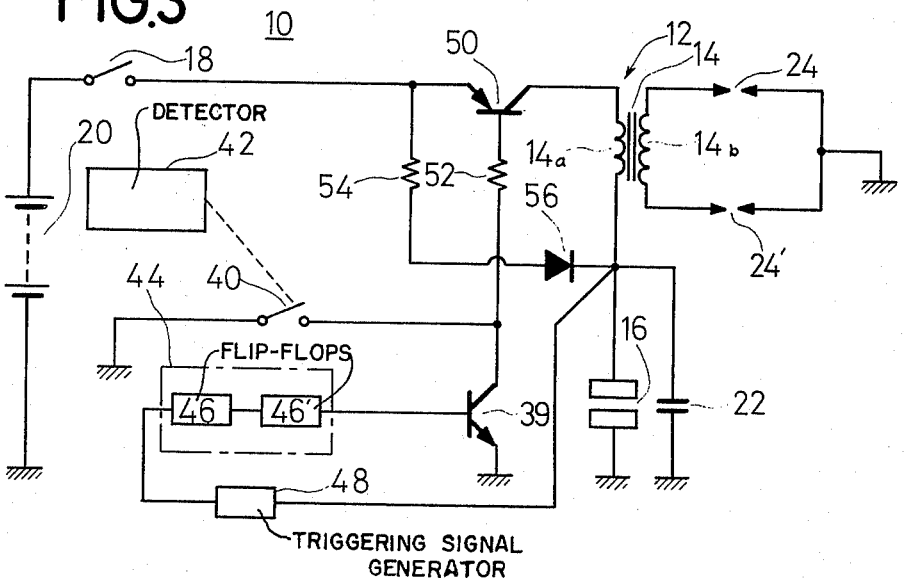

IGNITION SYSTEM FOR AN INTERNAL COMBUSTION ENGINE

BACKGROUND OF THE INVENTION

In engines of such type as rotary engines or two cycle reciprocating engines, it is known that they tend to repeat at random the ignition and the failure of ignition, which causes variation in torque and generation of disagreeable noise from the engines. Of late, there has been proposed an ignition system for an internal combustion engine which is so designed that the failure of ignition and the ignition are periodically repeated when the engine is decelerated or idling so as to prevent such variation in torque and disagreeable noise. Conventionally, such type ignition system has two sets of ignition circuits each including an ignition coil the primary coil element of which is connected to a contact breaker. One of the ignition circuits has the operative frequency of the corresponding contact breaker set at one half of that of the contact breaker in the other ignition circuit. In normal operation of the engine, the other ignition circuit operates, but when the engine is decelerated or idling, the one ignition circuit operates so that the engine ignites with one half of the frequency on normal operation of the engine. However, such type system makes maintenance and inspection troublesome because of two contact breakers provided therein. Furthermore, a mechanical reduction mechanism is required for reducing the operating frequency of the contact breaker in the first ignition circuit, which causes complicated construction of the ignition system and as a result such type system cannot be easily installed in the conventional engine.

SUMMARY OF THE INVENTION

Accordingly, it is a principal object of the present invention to provide an ignition system for an internal combustion engine wherein the ignition and the failure thereof can be periodically repeated by providing a single ignition circuit.

In accordance with the present invention, there is provided an ignition system for an internal combustion engine comprising a power supply, an ignition circuit including an ignition coil having a primary coil portion connected to at least one ignition plug, said ignition plug disposed within an operating chamber of said engine and a contact breaker connected in series to said primary coil portion, said ignition system characterized by further comprising means to override said ignition circuit; a triggering signal generator to generate a triggering signal each time said contact breaker is operated; a frequency divider to divide said triggering signal from said triggering signal generator so as to produce a divided signal with the frequency of 1-n times that of said triggering signal wherein $n$ is 2 or 4, said overriding means receiving said divided signal for its operation; and means to allow the operation of said overriding means only when said engine requires to periodically fail to ignite said operating chamber. Overriding means may be of such type that it short-circuits a primary voltage across said primary coil portion in response to said divided signal from said frequency divider and may alternatively be of such type that it interrupts a primary current through said ignition coil.

BRIEF DESCRIPTION OF THE DRAWING

The above and other objects and features of the present invention will be apparent from the description of the preferred embodiments taken with reference to the accompanying drawing wherein;

FIG. 1 is a schematic diagram of one embodiment of an ignition system in accordance with the present invention;

FIG. 2 shows wave forms of voltage across the components in the ignition system of FIG. 1; and FIG. 3 is a schematic diagram of another embodiment of the present invention.

DETAILED DESCRIPTION OF THE PREFERRED EMBODIMENTS

Referring now to FIG. 1, there is shown an ignition system for an internal combustion engine generally indicated by numeral 10 and the ignition system comprises a single ignition circuit 12 including an ignition coil 14 and a contact breaker 16. The ignition coil 14 includes a primary coil portion 14a having one of the ends connected through an ignition switch 18 to one end of a power supply 20, the other end of which is grounded. The other end of the primary coil portion **14*a* is connected to one end of the contact breaker 16, the other end of which is grounded. A capacitor 22 at its one end is connected to the connection between the primary coil portion 14*a* and the contact breaker 16 and at the other end is grounded. The ignition coil 14 also includes a secondary coil portion 14b having the opposite ends connected to one ends of respective ignition plugs 24 and 24', the other ends of which are grounded. The ignition plugs 24 and 24' are disposed within respective operating chambers (not shown) of the engine for igniting them. As understood by those skilled in the art, the normal operation of the ignition system is conventional. Briefly, with the ignition switch 18 closed, when the contact breaker 16 is closed, a primary current flows through the primary coil portion 14*a* of the ignition coil 14 and then when the contact breaker 16 is open, the primary current is interrupted so that the primary voltage is established across the primary coil portion 14*a*. FIG. 2*b* shows the wave forms of the primary voltage across the primary coil portion 14*a*. Thus, when the primary voltage is raised up, a secondary voltage is established across the secondary coil portion 14*b* as shown in FIG. 2*a* and as a result the ignition plugs 24 and 24' are sparked. As understood by those skilled in the art, one of the operating chambers, which is at explosion stage, is ignited while the other operating chamber which is at exhaust stage, is not ignited. Thus, the operating chambers are alternately ignited by each establishement of the secondary voltage shown in FIG. 2*a*. In FIG. 2*a*, the designation "A" shows the secondary voltage by which the ignition plug 24 ignites the corresponding chamber and the designation "B" shows the secondary voltage by which the ignition plug 24'** ignites the corresponding chamber.

Means to override the ignition circuit 12 is provided which in the illustrated embodiment, comprises a thyristor 30 connected in parallel to the primary coil portion **14*a* of the ignition coil 14. In order to trigger the thyristor 30, there is provided a series connection of an inductance 32 and a resistance 34, one end of which is connected to the point between the ignition switch 18 and the cathode of the thyristor 30 and the other end of which is connected through a forwarded diode 36 to the point between the primary coil portion 14a and the contact breaker 16. The point between the inductance 32 and the resistance 34 is connected through a forwarded diode 38 to the gate of the thyristor 30. It will be understood that the thyristor 30 serves to short-circuit the primary voltage established across the primary coil portion 14a of the ignition coil 14 when the contact breaker is interrupted. When the contact breaker 16 is closed, a current flows through the inductance 32, through the resistance 34 and the diode 36 and then through the contact breaker 16. Thereafter, when the contact breaker 16 is open, the current through the inductance 32 is abruptly interrupted with the result that the a voltage is induced across the inductance 32 with the polarity as shown in FIG. 1. Since the primary voltage appearing on interruption of the contact breaker is forwardly applied across the anode and cathode of the thyristor 30, the voltage across the inductance 32 triggers the thyristor 30 to thereby short-circuit the primary voltage across the primary coil portion 14***a*. Thus, the thyristor, when triggered, overrides the ignition circuit 12 which causes the failure of ignition.

Overriding means also includes means to control the current through the inductance 32 and in the illustrated embodiment, may preferably be in the form of a NPN type transistor 39. The transistor 39 has the emitter connected to the point between the resistance 34 and the diode 36 and the collector grounded to earth. If the transistor is in the conductive state, then a constant current continues to flow through the inductance 32 even though the contact breaker 16 is open, which causes the thyristor 30 to fail to be triggered to thereby properly operate the ignition circuit 12. On the other hand, if the transistor 39 is in the non-conductive state, then the thyristor 30 is triggered when the contact breaker 16 is open, as previously described to thereby override the ignition circuit 12.

There is provided means to allow the operation of overriding means only when the engine is decelerated or idling. It comprises a switching device 40 having one end connected to the point between the resistance 34 and the diode 36 and the other end grounded to earth. It also comprises a detector 42 to detect the operating condition of the internal combustion engine, such as the deceleration or idling of the engine, for instance and operatively associated with the switching device 40 so that when the detector detects the deceleration or idling of the engine, it permits the switching device 40 to be open. The detector may comprise a diaphragm device connected to an intake manifold of the engine, the diaphragmoperatively associated with the switching device 40 so that it is open when the engine is decelerated or idling. Alternatively, the detector may comprise picking up means to electrically pick up the revolution number of the engine in the form of a voltage signal as by means of either a tachogenerator or a lighting coil in a flywheel magneto and a differentiation circuit to differentiate the voltage signal from the picking up means for detecting the deceleration of the engine. In such case, the switching device 40 may comprise a relay or semiconductor switching means operated in response to the detected signal. It will be understood that when the switching device 40 is closed the thyristor 30 is never triggered in the same manner as described in connection with the transistor 39, but that when the switching device 40 is open, the thyristor 30 is triggered so as to override the ignition circuit 12.

There is provided a frequency divider 44 to periodically operate overriding means with a divided frequency of the ignition circuit. The frequency divider 44, in the illustrated embodiment, comprises a first and second flip-flop circuits 46 and 46′ which are arranged so that a triggering pulse signal may be modulated into a signal having the frequency which is a quarter of that of the pulse signal. Such frequency divider may be suitable for an internal combustion engine having two operating chambers, such as two cylinder engine as described hereinafter. It will be understood that in case of an internal combustion engine having four operating chambers, two ignition circuits are used which each have such frequency divider as described justabove mentioned. The output of the frequency divider 44 is connected to the base of the transistor 39 so that the output signal of the frequency divider 44 permits the transistor 39 to be conductive.

A triggering signal generator 48 is provided which may comprise a differentiation circuit and a rectifying circuit to rectify the output of the differentiation circuit. The triggering signal generator serves to produce a triggering pulse signal as shown in FIG. 2*c*. As seen from FIG. 1, the triggering signal generator 48 has the input connected to the point between the primary coil portion of the ignition coil 14 and the contact breaker 16 and has the output connected to the input of the frequency divider.

In operation contact breaker 16 is operated at the ignition time-intervals at which ignition is expected for normal operation of the engine, and, the triggering signal generator 48 generates a pulse signal as shown in FIG. 2c each time the contact breaker 16 is closed. The pulse signal triggers the first flip-flop circuit 46 which produces a signal shown in FIG. 2d and having the frequency which is one half of that of the pulse signal from the triggering signal generator 48. The devided signal further triggers the second flip-flop circuit 46′ which produces a divided signal varying at the frequency of one half of that of the output from the first flip-flop circuit 46. Thus, it will be understood that a divided signal of rectangular wave form as shown in FIG. 2e which varies at the frequency of a quarter of that of the pulse signal from the triggering signal generator 46, is produced at the output of the frequency divider 44. The finally divided signal from the frequency divider 44 is applied to the base of the transistor 39.

Thus, the transistor 39 is caused by the output signal from the frequency divider 44 to be periodically conductive and nonconductive. If the switching device 40 is open in response to the deceleration or idling of the engine, when the transistor 39 is non-conductive the thyristor is triggered so that the ignition circuit is overriden and when the transistor 39 is conductive the thyristor is not triggered with the result that the ignition circuit 12 is properly operated. Thus, during the period of $T_c$ shown in FIG. 2*e* the ignition circuit 12 permits the ignition plugs 24 and 24′ to alternately be operated for ignition of the corresponding operating chambers of the engine, but during the period of $T_o$ shown in FIG. 2e the ignition circuit 12 is never operated so that the ignition plugs fail to be operated. FIG. 2*f* shows the dotted lines in which the ignition plugs 24 and 24′ fail to be operated and the solid lines in which the ignition plugs 24 and 24′ are alternately operated. If the switching device 40 is closed, then the thyristor 30 is never triggered even though the transistor 39 is open, with the result that the ignition circuit is normally operated as shown in FIG. 2*a*. It will be understood that the diode 36 serves to prevent the primary voltage of the ignition coil from being applied to the transistor 39 and the power supply 20.

FIG. 3 shows another embodiment of overriding means used by the present invention. In this embodiment, overriding means may comprise a transistor 50 with the emitter connected to the ignition switch 18 and with the collector connected to the primary coil portion 14*a* of the ignition coil 14. The transistor 50 has the base connected through a resistance 52 to the collector of the transistor 39. The emitter of the transistor 50 is also connected through a resistance 54 and through a fowarded diode 56 to the point between the primary coil portion 14*a* of the ignition coil and the contact breaker 16. The ignition system of FIG. 3 is operated in a substantially identical manner to that of the foregoing embodiment, except that overriding means interrupts the premary current through the ignition circuit 12 when the engine is decelerated or idling. More particularly, if the switching device 40 is open, when the transistor 39 is non-conductive the transistor 50 is caused to be non-conductive, and therefore the primary current is prevented from flowing through the ignition circuit 12. Thus, the ignition circuit 12 is never operated so that the ignition plugs fail to be sparked. On the other hand, when the transistor 39 is conductive, the transistor 50 is permitted to be conductive so that the ignition circuit 12 is properly operated. If the switching device 40 is closed, then the ignition circuit is normally operated even though the transistor is periodically non-conductive.

While the aforementioned embodiments are suitably applied to the engine having two operating chambers, the present invention can be applied to an engine having four operating chambers. In the latter case, two ignition circuits are used which each have the same arrangement as described hereinabove and one of the ignition circuits has the corresponding ignition plugs disposed within two of four operating chambers and the other ignition circuit has the corresponding ignition plugs disposed within the other operating chambers. Further, in case of an engine having a single operating chamber, the frequency divider may be so designed that it produces a signal having the frequency of one half of that of the pulse signal from the triggering signal generator.

Although some preferred embodiments of the present invention have been described with reference to the accompanying drawing, they are by way of example, and it will be apparent to those skilled in the art that various changes and modifications may be made within the spirit and scope of the present invention, which is intended to be defined only to the appended claim.

What is claimed is:

1. An ignition system for an internal combustion engine which system includes a power supply and an ignition circuit including an ignition coil having a primary coil portion connected to said power supply and a secondary coil portion connected to at least one ignition plug, said ignition plug disposed within an operating chamber of an engine, a contact breaker to be operated at the ignition time intervals at which ignition is expected for normal operation of the engine, and said contact breaker is connected to said primary coil portion, said ignition system characterized by a triggering signal generator to generate a triggering signal each time said contact breaker is operated; a frequency divider to divide said triggering signal from said triggering signal generator so as to produce a divided signal with the frequency of 1-n times the frequency of said triggering signal wherein *n* is 2 or 4; an overriding means to periodically override said ignition circuit in response to said divided signal, so that ignition of the engine is caused to fail periodically; and means to allow the operation of said overriding means responsive to conditions requiring failure of ignition of the operating chamber, said overriding means comprising first semiconductor switching means connected in parallel to said primary coil portion of said ignition coil whereby the primary voltage across said primary coil portion is short-circuited when said semiconductor switching means is conductive, and second semiconductor switching means to prevent said first semiconductor switching means from being triggered when said second semiconductor switching means is conductive, said frequency divider arranged so that it permits said second semiconductor switching means to be conductive when it outputs said divided signal.

2. An ignition system for an internal combustion engine which system includes a power supply and an ignition circuit including an ignition coil having a primary coil portion connected to said power supply and a secondary coil portion connected to at least one ignition plug, said ignition plug disposed within an operating chamber of an engine, a contact breaker to be operated at the ignition time intervals at which ignition is expected for normal operation of the engine, and said contact breaker is connected to said primary coil portion, said ignition system characterized by a triggering signal generator to generate a triggering signal each time said contact breaker is operated; a frequency divider to divide said triggering signal from said triggering signal generator so as to produce a divided signal with the frequency of 1-n times the frequency of said triggering signal wherein n is 2 or 4; an overriding means to periodically override said ignition circuit in response to said divided signal, so that ignition of the engine is caused to fail periodically; and means to allow the operation of said overriding means responsive to conditions requiring failure of ignition of the operating chamber, said overriding means comprising a first semiconductor switching means in series to said primary coil portion of said ignition coil and a second semiconductor switching means to prevent said first semiconductor switching means from its conduction when said second semiconductor switching means is non-conductive, said frequency divider arranged so that it permits said second semiconductor switching means to be conductive when it outputs said divided signal.

3. An ignition system as set forth in claim 1, wherein said frequency divider comprises flip-flop means.

4. An ignition system as set forth in claim 1, wherein said engine has two operating chambers in which respective ignition plugs are disposed and connected in series to said secondary coil portion and wherein said frequency divider comprises a first flip-flop circuit with the input connected to said triggering signal generator and a second flip-flop circuit with the input connected to the output of said first flip-flop circuit and with the output connected to said second semiconductor switching means so that the latter is conductive when said second flip-flop circuit produces the divided signal therefrom.

5. An ignition system as set forth in claim 2, wherein said engine has two operating chambers in which respective ignition plugs are disposed, respectively and connected in series to said secondary coil portion of said ignition coil and wherein said frequency divider comprises a first flip-flop circuit with the input connected to said triggering signal generator and a second flip-flop circuit with the input connected to the output of said first flip-flop circuit and with the output connected to said second semiconductor switching means so that the latter is conductive when said second flip-flop circuit produces the divided signal therefrom.

6. An ignition system as set forth in claim 1, wherein said means to allow the operation of said overriding means comprises a switching device connected in parallel to said second semiconductor switching means and a detector to detect the deceleration of said engine and operatively associated with said switching device so that when the deceleration is detected said switching device is open.

7. An ignition system as set forth in claim 1, wherein said means to allow the operation of said overriding means comprises a switching device connected in parallel to said second semiconductor switching means and a detector to detect the idling of said engine and operatively associated with said switching device so that when the idling is detected said switching device is open.

8. An ignition system as set forth in claim 2, wherein said means to allow the operation of said overriding means comprises a switching device connected in parallel to said second semiconductor switching means and a detector to detect the deceleration of said engine and operatively associated with said switching device so that when the deceleration is detected said switching device is open.

9. An ignition system as set forth in claim 2, wherein said means to allow the operation of said overriding means comprises a switching device connected in parallel to said second semiconductor switching means and a detector to detect the idling of said engine and operatively associated with said switching device so that when the idling is detected said switching device is open.

* * * * *